US005638846A

United States Patent [19]

Basso

[11] Patent Number: 5,638,846

[45] Date of Patent: Jun. 17, 1997

[54] UMBRELLA

[76] Inventor: Pierre-Marie Basso, 40, avenue des Alpes, 1820 Montreux, Switzerland

[21] Appl. No.: 669,475

[22] PCT Filed: Jan. 9, 1995

[86] PCT No.: PCT/IB95/00015

§ 371 Date: Jul. 9, 1996

§ 102(e) Date: Jul. 9, 1996

[87] PCT Pub. No.: WO95/18554

PCT Pub. Date: Jul. 13, 1995

[30] Foreign Application Priority Data

Jan. 11, 1994 [CH] Switzerland ..... 69/94

[51] Int. Cl.[6] ..... A45B 13/00

[52] U.S. Cl. ..... 135/19.5; 135/28

[58] Field of Search ..... 135/15.1, 28, 29, 135/19.5, 37, 38, 39, 41, 31

[56] References Cited

U.S. PATENT DOCUMENTS

| | | | |
|---|---|---|---|
| 1,547,538 | 7/1925 | Vincent | 135/19.5 X |
| 4,182,353 | 1/1980 | Hermanson | 135/19.5 |
| 4,215,711 | 8/1980 | Hermanson | 135/19.5 |
| 4,624,275 | 11/1986 | Baldwin | 135/19.5 |
| 4,736,761 | 4/1988 | Warfield et al. | 135/29 X |

FOREIGN PATENT DOCUMENTS

| | | | |
|---|---|---|---|
| 1342084 | 9/1963 | France | 135/19.5 |
| 0502468 | 8/1956 | Italy . | |

*Primary Examiner*—Lanna Mai

*Attorney, Agent, or Firm*—Clifford W. Browning; Woodard, Emhardt, Naughton, Moriarty & McNett

[57] ABSTRACT

An umbrella having a simplified construction which dispenses with the stretcher members of conventional umbrellas and has one end hinged to the central portion of each rib. Said umbrella includes a runner (4) axially slidable along the umbrella pole (1) between a folded position in which the ribs (3, 3') can be folded against the pole, and an unfurled position in which the runner engages the ribs and holds them in the extended position. For this purpose, the runner comprises an upper frusto-conical portion (46) engageable with the ends (35) of the reinforcing portions (31) of the ribs.

18 Claims, 4 Drawing Sheets

UMBRELLA

The present invention relates to an umbrella, comprising a rod, one end of which serves as a handle, while the other end forms an end fitting on which are hinged radial ribs, and a slide block mounted on an axial slideway along the length of the rod, between an opening position in which it comes to a stop against the said ribs, maintaining them in the deployed position, and a closed position in which the ribs can fold in against the rod.

Umbrellas of the traditional type involve the use of a multiplicity of components, which require substantial labour for assembly and which cause their price to be relatively high.

An umbrella of a simple structure, thanks in particular to the elimination of the elements in the shape of a flying buttress, of which one of the ends is capable of articulation in the central area of the corresponding ribs, is described in WO-A-90/11702. This umbrella, of the type comprising a slide block such as that described in the preamble, comprises locking means which are capable of disconnection, and include a shaping of the slide block designed in such a way as to cooperate with the shaping of the ribs so as to ensure, with the umbrella in the deployed position, that a locking effect will be provided for the ribs in the deployed position, and a temporary locking effect, in the axial position, of the slide block.

However, the design of these locking means is complex, and demands a high degree of precision in manufacture in order to achieve a sufficient deployment of the ribs. If the umbrella is made of plastic material, it is virtually impossible to achieve a robust deployment of the ribs, in such a way as to stretch the fabric of the umbrella properly. Moreover, due to the fact of their shape, the locking means of the ribs in the deployed position can be easily unseated, and the umbrella tends to collapse at the lightest puff of wind.

The aim of the present invention is to propose an umbrella of simplified structure, which will allow for the disadvantages of the simplified design of umbrella, as described in WO-A-90/11702, to be overcome.

To this end, the invention relates to an umbrella comprising a rod, one end of which serves as a handle, while the other end forms an end mounting on which are hinged radial ribs, and a slide block mounted on an axial slide way along the length of the rod, between an opening position in which it comes to a stop against the said ribs, maintaining them in a deployed position, and a closed position in which the ribs can fold in against the rod, such as is defined in claim 1.

The umbrella according to the invention can to advantage be made entirely of plastic material.

Other advantages of the invention can be derived from the description which follows, given by way of example, and which relates to the appended drawings, in which.

Figure 1:
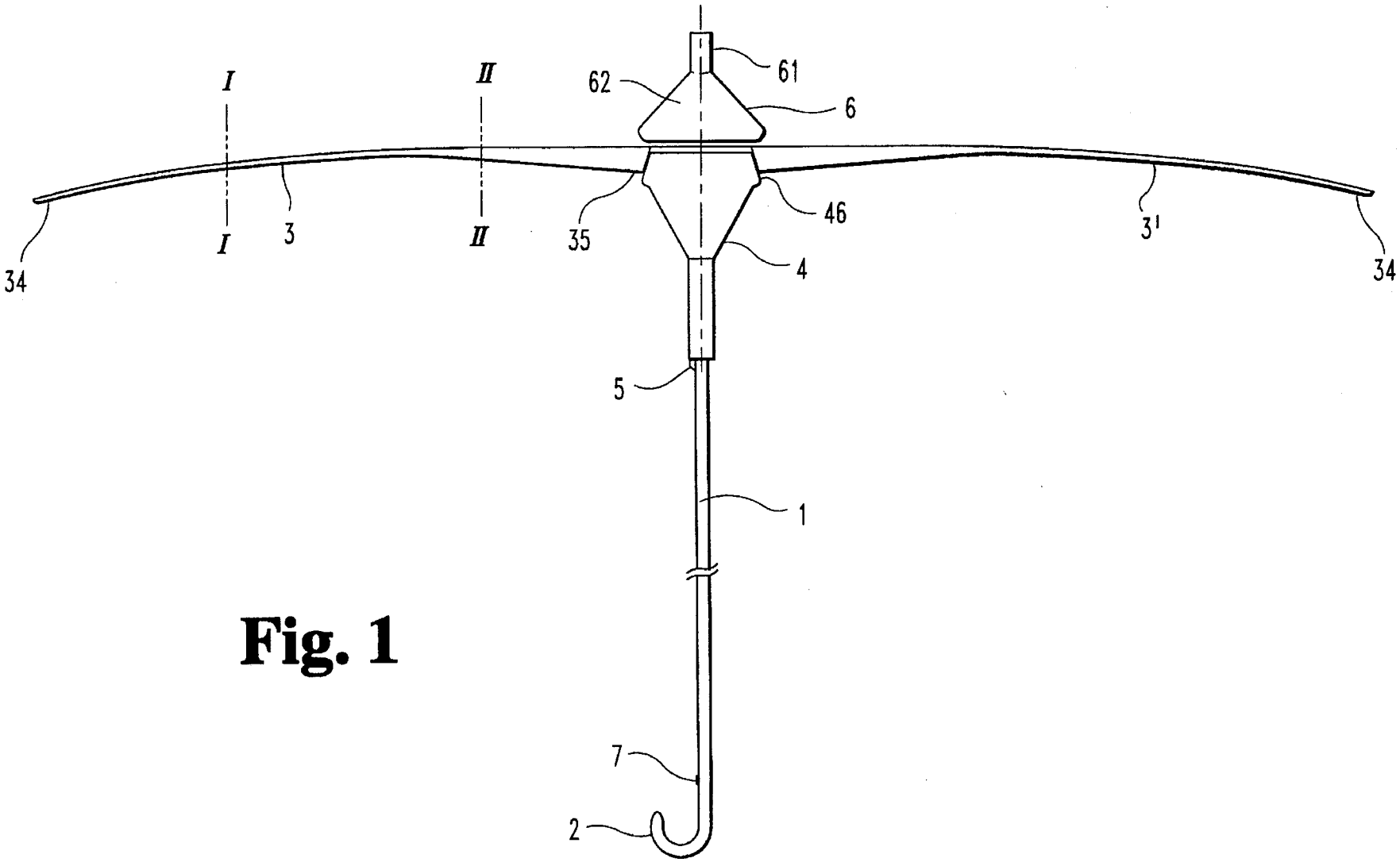
FIG. 1 is a view of an axial section of a schematic design of the umbrella according to the invention, in the opened position.
Figure 2:
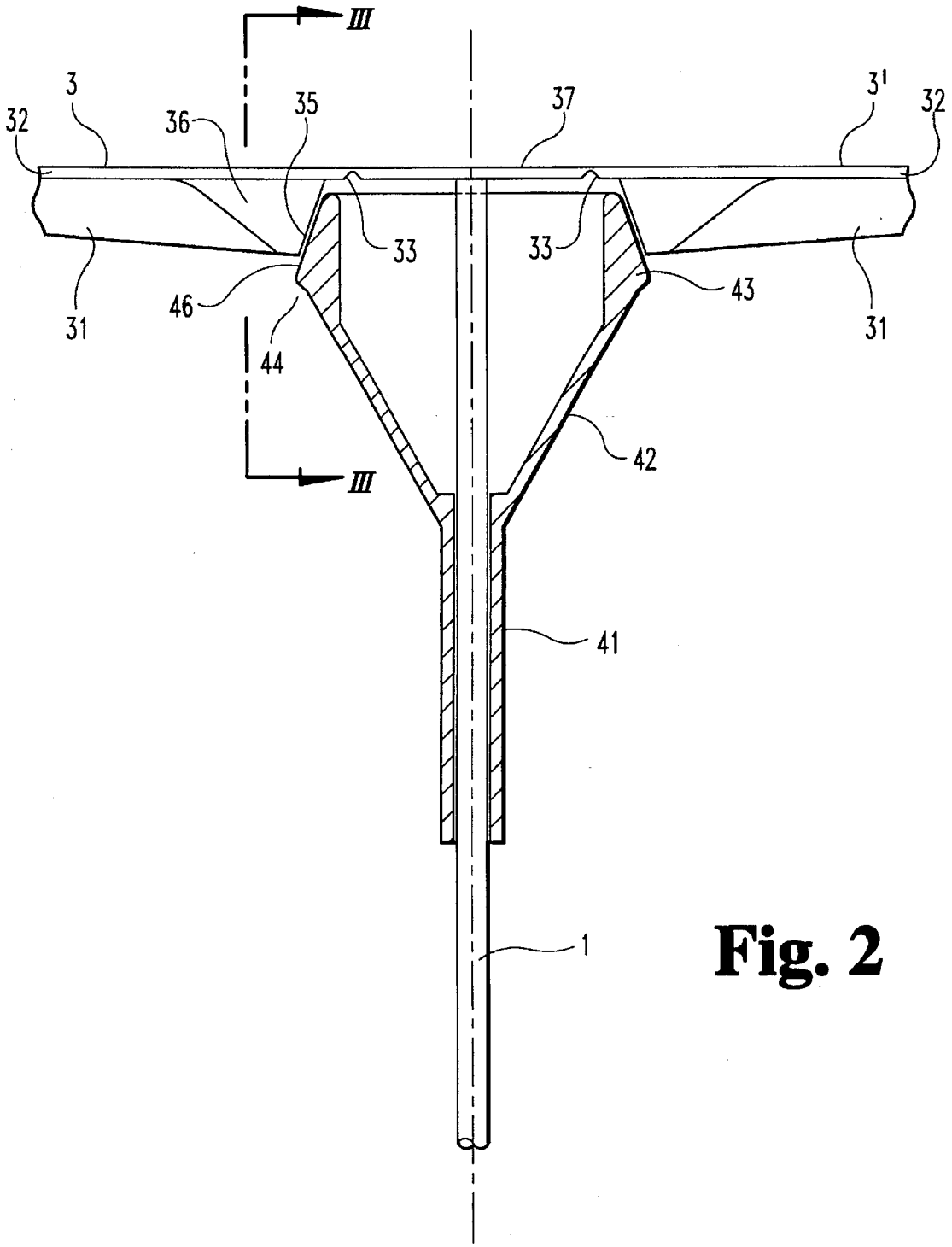
FIG. 2 is a detailed section of the umbrella in FIG. 1, showing the manner in which the upper end of the slide block cooperates with the end of the ribs, in order to maintain the ribs in the deployed position.

The umbrella represented in FIG. 1 comprises a rod 1, which terminates at its lower end in a handle 2, and a number of ribs 3 (for example, eight) intended to deploy the fabric of the umbrella. A slide block 4 is mounted along the length of the rod 1, in such a way that it can slide axially along the length of the rod between a closed position, in which the ribs can be folded in against the rod, and an open position (such as shown in FIGS. 1 and 2), in which it comes to a stop against the ribs, in such a way as to maintain them in the deployed position.

The side block 4 comprises a lower piece 41, of tubular shape, of an internal diameter almost equal to the external diameter of the rod 1, surmounted by a second part 42, of truncated shape, opening upwards, of a thickness which is approximately equal to that of the lower part, and the smallest diameter of which is equal to the diameter of the first part. The second part is itself surmounted by a third part 43, containing in its lower area a flared section 44, projecting towards the outside in relation to the outer surface of the second part 42, and including an upper area of which the outer diameter diminishes towards the top, in such a way as to form a truncated flange 46, intended to cooperate with the ribs 3 for the purpose of their deployment as described hereafter. The internal diameter of the third part 43 may be constant along its whole height, as shown in FIG. 2, equal to the internal diameter of the upper end of the second part 42. Naturally however, the third part 43 may equally be provided with a variable internal diameter, and the slide block then having a thickness which is more or less constant along its entire height. The slide block may be made from one single moulded piece.

Figure 7:
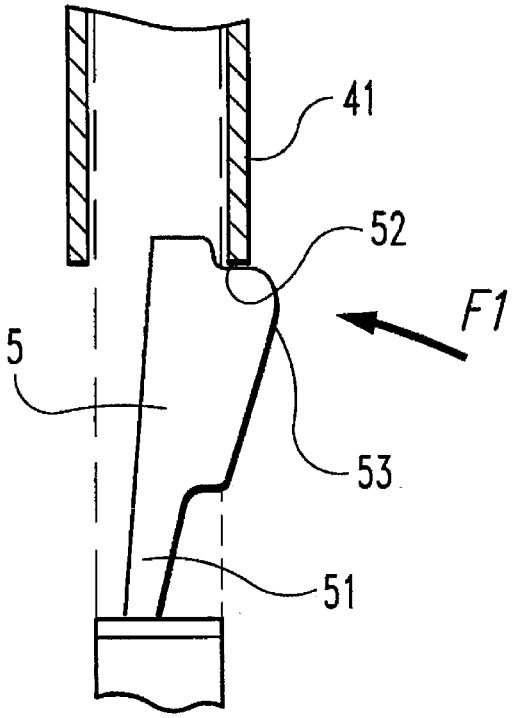
FIG. 7 is a detailed schematic view of an example of the locking device of the slide block in the open position of the umbrella.

The maintaining of the slide block in the open position is effected with the aid of a flexible locking element 5, acting on the lower end of the slide block. As shown in FIG. 7, this element S comprises, at its lower end, a tongue 51, which is of one piece with the rod 1 of the umbrella, and, at its upper end, a support flange 52, intended to lock the slide block 4 in the open position of the umbrella. For the unlocking of the slide block it is sufficient to press the thumb in the direction of the arrow F1 on the front part 53 of the element 5, which then yields in the area of the tongue 51.

The ribs may be formed by pairs of ribs 3, 3', each of the ribs of a pair being connected by a central circular element 37 by way of a portion with a reduced thickness 33, forming a flexible hinge. Each pair of ribs can be made in a single piece of moulded plastic material.

The upper part 6, in the shape of a cap, fitted at the end of the rod 1, as well as the means for securing the cap and the central part 37 of each pair of ribs on the rod may be made, depending on their principle, in the manner described in document WO-A-90/11702. To this end, the central element 37 features a central borehole, which is intended to engage and accommodate a cylindrical portion located at the upper end of the rod, which likewise engages with the cap part 6.

Figure 3:
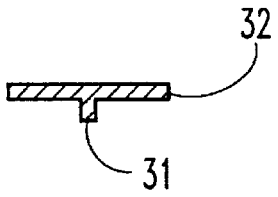
FIG. 3 is a section I—I of a rib of the umbrella from FIG. 1.
Figure 4:
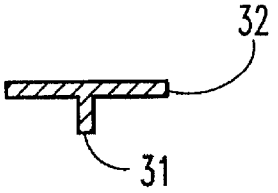
FIG. 4 is a section II—II of a rib of the umbrella from FIG. 1.
Figure 5:
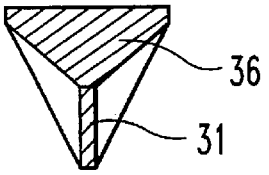
FIG. 5 is a sectional view III—III of the rib from FIG. 2.
Figure 6:
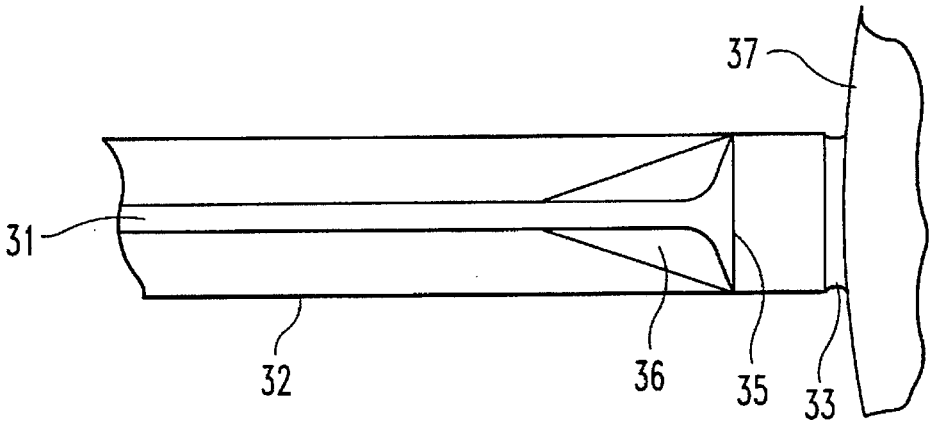
FIG. 6 is a detailed view from below of the end of the rib arranged to cooperate with the slide block.

Each of the ribs 3 presents, in section (FIGS. 3 and 4), a T-shape, consisting of a flat main upper section 32, and a reinforcing section 31, the end 35 of which, located on the side of the hinge 33 of the rib, is preferably convex in shape, intended to cooperate with the slide block 4 for the deployment of the ribs. As can be seen in FIGS. 2, 5 and 6, in the area 36 of the end of the reinforcement part 31, located on the side of the hinge 33 of the rib, the reinforcing becomes progressively thicker from the top, towards its end, in such a way as to increase its rigidity.

The deployment of the ribs is achieved by the truncated flange 46 of the upper part of the slide block 4 harmonising with the end 35 of the reinforcement part of each of the ribs. The combination of the truncated shape 46 of the upper part of the slide block and the end part 35 of the reinforcement parts of the ribs implies that, the more the slide block is pushed upwards, the more the ribs deploy, and, as a result, the more the fabric is stretched.

As shown in FIG. 1, the height of the reinforcement part 31 is reduced progressively from two-thirds of its height, along the first third of the length of the rib (starting from the hinged end of the rib), then remains more or less constant along the remainder of the length of the rib. This configuration, which provides for greater flexibility of the ribs at their peripheral ends, necessarily involves a flying buttress effect or arching of the rib, when the fabric which is fixed on the one hand to the centre of the umbrella on the inside of the cap element 6 and, on the other hand, to the peripheral end 24 of each rib, is placed under tension. This results in an extended shape which is more or less equal to that of a conventional umbrella, without the risk of the umbrella subsiding. The fabric can be secured at the end of the ribs, for example, by welding or adhesive bonding.

The shape of the slide block, and particularly the substantial inner diameter of the upper part of the slide block, in harmony with the flared shape of the upper stop of the slide block, allows for the easy allocation of the ends of the ribs and of the fabric of the umbrella to the inside of the slide block, when the ribs have been disposed in the folded position along the rod.

Figure 8:
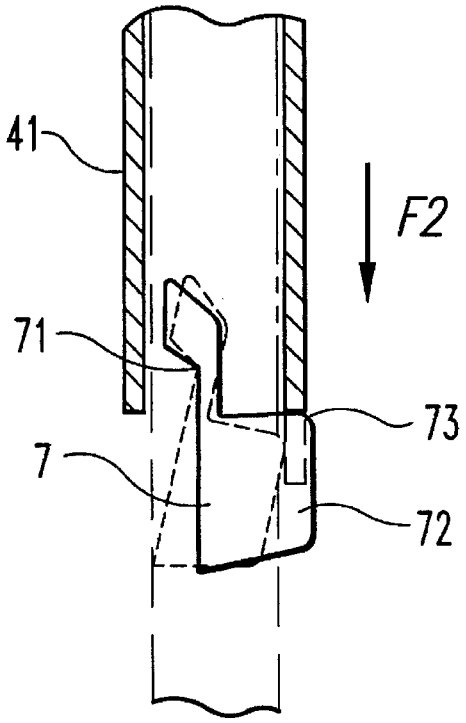
FIG. 8 is a detailed schematic view of an embodiment of the slide block locking device in the closed position of the umbrella.

The slide block can be reliably maintained in the closed position thanks to a flexible locking device 7, acting on the lower end of the slide block. As shown in FIG. 8, this element 7 comprises, at its upper end, a tongue 71 which is of one piece with the rod 1 of the umbrella, and a main piece 72 consisting of an upper flange 73, against the outer part of which the lower end of the slide block comes to a stop. Thanks to the shape of the element 7 and its position in a state of rest in relation to the lower end of the slide block 4, the slide block can be released simply by pulling the slide block downwards, in the direction of the arrow F2, which is sufficient to cause the element 7 to flex, as shown by the dotted line in FIG. 8.

In order to avoid any water being retained inside the cap element 6 of the umbrella, when the umbrella has been closed again and when it is carried vertically, suspended by the handle, one or more holes may be provided in the cap element.

As shown in FIG. 1, the cap element 6 may feature a lower part 62 of a truncated external shape, with rounded lower edges, and an upper part 61 of cylindrical shape. The upper part 61 may be formed in the manner of an allocation compartment, and may be reinforced by an upper closure hood. In this case, the water drain holes are provided in the upper section of the truncated part 62.

The rod (1) may be of tubular shape or designed in such a way as to provide a S shaped section, analogous to that proposed in Document WO-A-90/11702, and made of extruded or injected plastic material.

I claim:

1. An umbrella comprising a rod, one end of which serves as a handle, while the other end forms a mount on which are hinged radial ribs, and a slide block mounted on an axial slideway along the length of the rod, between an opening position in which it comes to a stop against the said ribs, maintaining them in a deployed position, and a closed position in which the ribs can fold in against the rod, wherein the slide block comprises an upper part, featuring an outer surface with a diameter which tapers towards the top, shaped to cooperate with a projecting shaping of each of the ribs, so as to maintain the ribs in the deployed position when the slide block is maintained in the open position, said projecting shaping of each of the ribs comprising to that effect a contact surface with a substantially straight generatrix, oriented so as to be in a position substantially parallel to the outer surface of the slide block when the ribs are in the deployed position.

2. An umbrella according to claim 1, wherein the outer surface of the said upper part of the slide block is of a truncated shape.

3. An umbrella according to claim 1, wherein the slide block comprises a lower part of tubular shape, of a diameter almost equal to the outside diameter of the shaft, surmounted by a second part of truncated shape, opening upwards with a thickness more or less equal to that of the lower part, and the smallest diameter of which is equal to the diameter of the lower part, and an upper part comprising in its lower area a flared section projecting towards the outside in relation to the outer surface of the second part and comprising an upper area of which the diameter is reduced upwards, in such a way as to form a truncated flange.

4. An umbrella according to claim 3, wherein the upper end of the slide block is rounded.

5. An umbrella according to claim 4, wherein the slide block is of one single piece.

6. An umbrella according to claim 5, comprising a locking element for the slide block in the open position, said locking element comprising at its lower end a tongue which is of one piece with the rod of the umbrella, and at its upper end a support flange on which the lower end of the slide block stops when arranged in the open position of the umbrella.

7. An umbrella according to claim 6, wherein each of the ribs features a T-shape in section, comprising a flat main upper part and a reinforcement part of which the end located on the side of the articulation of the rib features a convex rounded shape intended to cooperate with the slide block for the deployment of the rib.

8. An umbrella according to claim 7, wherein the height of the reinforcement part diminishes progressively, from its end located at the side of the hinge of the rib, of the two-thirds of its height at least along the first third of the length of the rib, and then remains quasi constant along the remainder of the length of the rib.

9. An umbrella according to claim 8, wherein the reinforcing part becomes progressively thicker in its end area located at the side of the hinge of the rib, in such a way as to increase its rigidity.

10. An umbrella according to claim 9, made entirely of plastic material.

11. An umbrella according to claim 1, wherein the slide block is of one single piece.

12. An umbrella according to claim 1, comprising a locking element for the slide block in the open position, said locking element comprising at its lower end a tongue which is of one piece with the rod of the umbrella, and at its upper end a support flange on which the lower end of the slide block stops when arranged in the open position of the umbrella.

13. An umbrella according to claim 1, wherein each of the ribs features a T-shape in section, comprising a flat main upper part and a reinforcement part of which the end located on the side of the articulation of the rib features a convex rounded shape intended to cooperate with the slide block for the deployment of the rib.

14. An umbrella according to claim 13, wherein the height of the reinforcement part diminishes progressively, from its end located at the side of the hinge of the rib, of the two-thirds of its height at least along the first third of the length of the rib, and then remains quasi constant along the remainder of the length of the rib.

15. An umbrella according to claim 14, wherein the reinforcing part becomes progressively thicker in its end area located at the side of the hinge of the rib, in such a way as to increase its rigidity.

16. An umbrella according to claim 15, made entirely of plastic material.

17. An umbrella according to claim 1, made entirely of plastic material.

18. An umbrella according to claim 1, wherein the upper end of the slide block is rounded.

* * * * *